United States Patent [19]

Yahiro et al.

[11] Patent Number: 4,494,494

[45] Date of Patent: Jan. 22, 1985

[54] V-TYPE ENGINE

[75] Inventors: Tetsuji Yahiro, Higashihiroshima; Haruyoshi Ishimi, Hiroshima, both of Japan

[73] Assignee: Mazda Motor Corporation, Japan

[21] Appl. No.: 601,728

[22] Filed: Apr. 18, 1984

[30] Foreign Application Priority Data

Apr. 18, 1983 [JP] Japan ..... 58-68789

[51] Int. Cl.[3] ..... F02B 75/22

[52] U.S. Cl. ..... 123/55 VS; 123/196 R; 123/90.33

[58] Field of Search ..... 123/55 V, 55 VS, 55 VE, 123/55 VF, 196 R, 196 V, 193 R, 193 C, 193 CH, 90.33, 90.34

[56] References Cited

U.S. PATENT DOCUMENTS

| | | | |
|---|---|---|---|
| 2,996,050 | 8/1961 | Caris | 123/90.34 |
| 4,121,558 | 10/1978 | Sakakibara et al. | 123/196 R |
| 4,343,270 | 8/1982 | Kawabe | 123/90.34 |

FOREIGN PATENT DOCUMENTS

| | | | |
|---|---|---|---|
| 575263 | 5/1959 | Canada | 123/90.33 |
| 55-114845 | 2/1980 | Japan . | |

*Primary Examiner*—E. Rollins Cross

*Attorney, Agent, or Firm*—Gerald J. Ferguson, Jr.; Joseph J. Baker

[57] ABSTRACT

A V-type engine comprises a cylinder block, and first and second cylinder heads mounted on the cylinder block to form first and second cylinder banks arranged in V-shape, the front end face of the cylinder block at the first cylinder bank being substantially flush with the front end face of the cylinder block at the second cylinder head, the rear end face of the cylinder block at the first cylinder block being substantially flush with the rear end face of the cylinder block at the second cylinder block, and the first and second cylinder heads being shaped to conform to the shape of the cylinder block. Each cylinder bank is provided with a row of cylinders extending axially between the front and rear end surfaces thereof. The row of the cylinders in the first cylinder bank starts from a location spaced apart from the front end face and terminates at a location near the rear end face, while the row of the cylinders in the second cylinder bank starts from a location near the front end face and terminates at a location spaced apart from the rear end face so that the row of the cylinders in the first cylinder bank is axially rearwardly displaced from that in the second cylinder bank. An oil-return passage to the crankcase extending through the cylinder block and the cylinder head to communicate the crankcase and the upper surface of the cylinder head is formed at a location between the foremost cylinder in the first cylinder bank and the front end face of the first cylinder bank and/or at a location between the rearmost cylinder in the second bank and the rear end face of the second cylinder bank.

7 Claims, 8 Drawing Figures

V-TYPE ENGINE

BACKGROUND OF THE INVENTION

1. Field of the Invention

This invention relates to a V-type engine.

2. Description of the Prior Art

In Japanese Unexamined Patent Publication No. 55(1980)-114845, there is disclosed a V-type engine in which a pair of V-arranged banks are mutually displaced in the axial direction of the crankshaft so as to provide spaces at a location axially ahead of one bank and at a location axially behind the other bank, and auxiliary mechanisms for the engine to be driven by the crankshaft are separately disposed in the spaces. With this arrangement, the overall size of the engine can be reduced. However, this arrangement is disadvantageous in that an oil-return passage having a sufficient cross-sectional area for oil from the upper surface of the cylinder head cannot be formed in the cylinder block since the end surfaces of the cylinder block are stepped, i.e., the front end and the rear end of one bank are respectively displaced axially from those of the other bank. This leads to poor recovery of oil. This is a significant problem particularly in a V-type overhead-camshaft engine in which a large amount of oil is fed to the cylinder heads.

SUMMARY OF THE INVENTION

The primary object of the present invention is to provide a V-type engine in which a wide oil-return passage can be formed between the space in the cylinder head of each cylinder bank and the interior space of the crankcase so that oil fed to the cylinder head can be quickly recovered into the crankcase without increasing the overall size of the engine.

Another object of the present invention is to provide a V-type engine in which the cylinder heads for the respective banks may be of identical shape and interchangeable with each other so that the manufacturing cost can be lowered.

The V-type engine of the present invention comprises a cylinder block, and first and second cylinder heads mounted on the cylinder block to form first and second cylinder banks arranged in V-shape, the front end face of the cylinder block at the first cylinder bank being substantially flush with the front end face of the cylinder block at the second cylinder head, the rear end face of the cylinder block at the first cylinder block being substantially flush with the rear end face of the cylinder block at the second cylinder block, and the first and second cylinder heads being shaped to conform to the shape of the cylinder block. Each cylinder bank is provided with a row of cylinders extending axially between the front and rear end surfaces thereof. The row of the cylinders in the first cylinder bank starts from a location spaced apart from the front end face and terminates at a location near the rear end face, while the row of the cylinders in the second cylinder bank starts from a location near the front end face and terminates at a location spaced apart from the rear end face so that the row of the cylinders in the first cylinder bank is axially rearwardly displaced from that in the second cylinder bank. An oil-return passage to the crankcase extending through the cylinder block and the cylinder head to communicate the crankcase and the upper surface of the cylinder head is formed at a location between the foremost cylinder in the first cylinder bank and the front end face of the first cylinder bank and/or at a location between the rearmost cylinder in the second bank and the rear end face of the second cylinder bank.

That is, in the V-type engine of the present invention, since the oil-return passage is formed in the dead space of the engine, it can be sufficiently large in cross-sectional area, thereby improving recovery of oil to the crankcase.

In one preferred embodiment of the present invention, a pair of oil-return passages are formed respectively at a location between the foremost cylinder in the first cylinder bank and the front end face of the first cylinder bank, and at a location between the rearmost cylinder in the second cylinder bank and the rear end face of the second cylinder bank. It is particularly preferred that the oil-return passages be identical to each other in shape and size and disposed symmetrically with respect to the center of the engine so that the first and second cylinder heads may be identically shaped, interchangeable parts.

Further since the oil-return passages have a large volume, they can function as pressure buffer chambers for alleviating variation of the pressure in the crankcase. In another preferred embodiment of the present invention, a pressure buffer chamber is formed between the first and second cylinder banks to communicate with the interior of the crankcase, and said oil-return passages are connected with the pressure buffer chamber to cooperate therewith in alleviating the pressure variation in the crankcase.

DESCRIPTION OF THE PREFERRED EMBODIMENT

Figure 1:
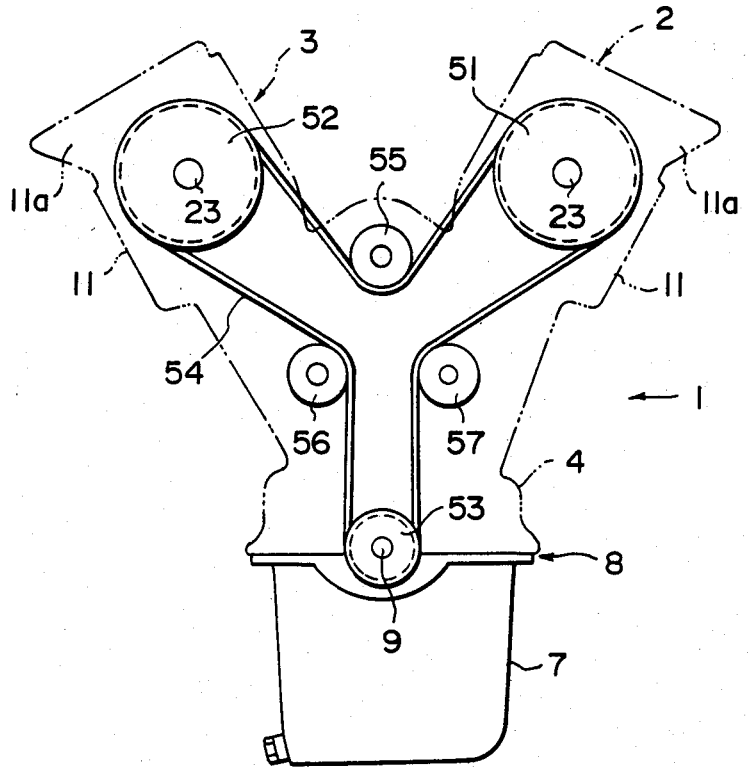
FIG. 1 is a schematic front elevational view of a V-6 OHC engine in accordance with an embodiment of the present invention.

Referring to FIGS. 1 to 8, a V-6 OHC engine 1 in accordance with an embodiment of the present invention comprises a cylinder block 4 a first cylinder bank 2 and a second cylinder bank 3 arranged in V-shape. Secured to the bottom of the cylinder block 4 is an oil pan 7 which forms, together with the lower part of the cylinder block 4, a crankcase 8 for accommodating a crankshaft 9. Mounted on the top surfaces of the first and second banks 2 and 3 are cylinder heads 11 on which a pair of camshafts 23 are respectively supported. The camshafts 23 are operatively connected with the crankshaft 9 at their front ends through a transmission means so that they are driven to rotate in synchronization with the crankshaft 9. The transmission means comprises timing pulleys 51 and 52 respectively fixed to the front ends of the camshafts 23, a crank pulley 53 fixed to the front end of the crankshaft 9, and a timing belt 54 entrained around the pulleys 51, 52 and 53. Reference numerals 55, 56 and 57 denote idlers for the timing belt 54. A pair of head covers 11*a* are respectively mounted on the cylinder heads 11 to define spaces V therebetween for accommodating valve driving mechanisms M to be described later.

Figure 3:
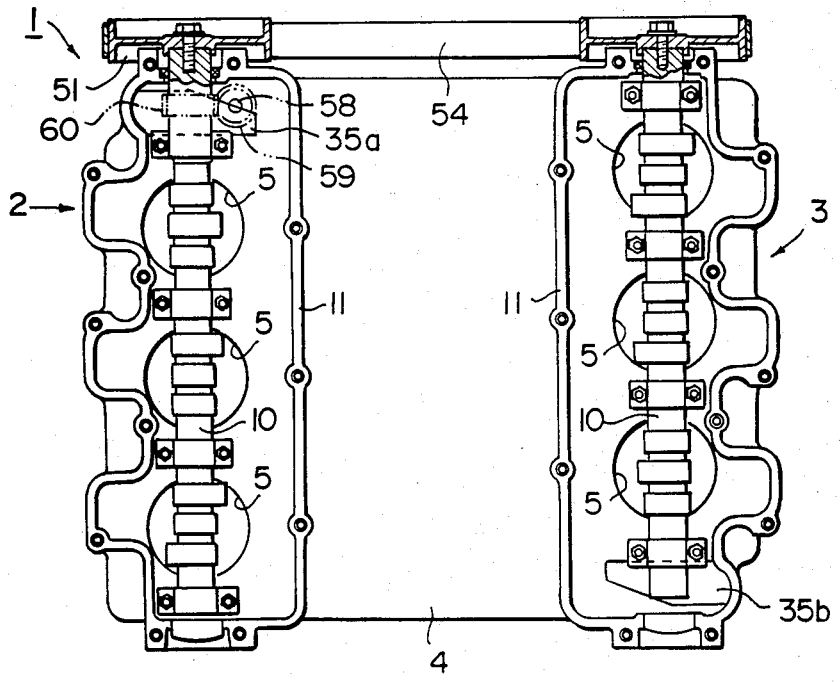
FIG. 3 is a plan view schematically showing the arrangement in the cylinder heads of the engine.
Figure 4:
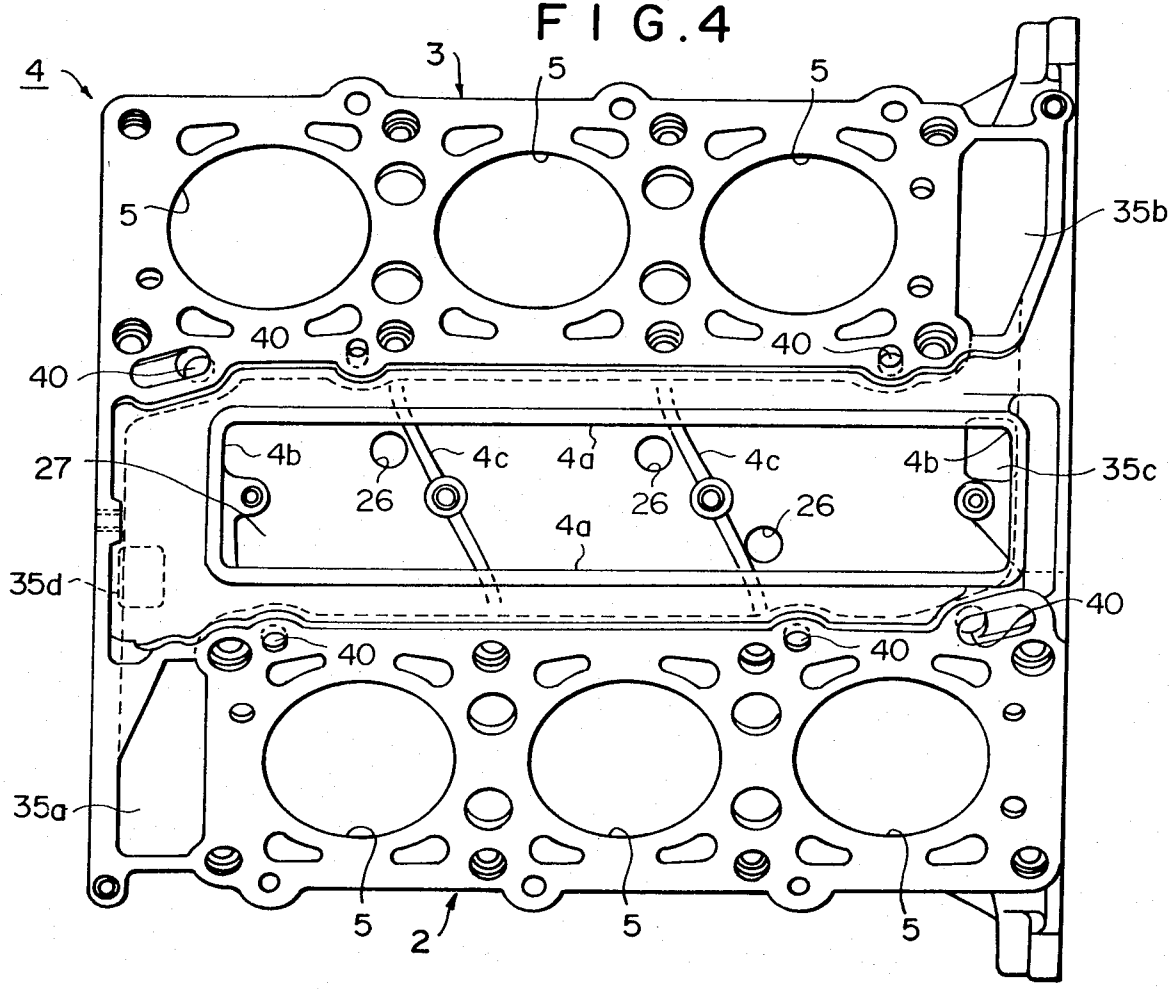
FIG. 4 is a plan view of the cylinder block of the engine.
Figure 5:
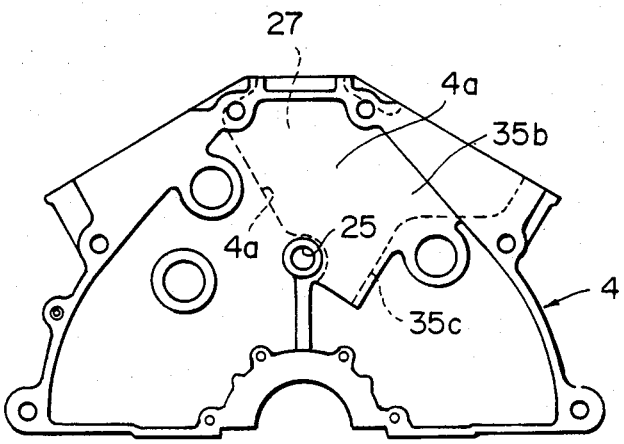
FIG. 5 is a rear end view of the cylinder block.
Figure 6:
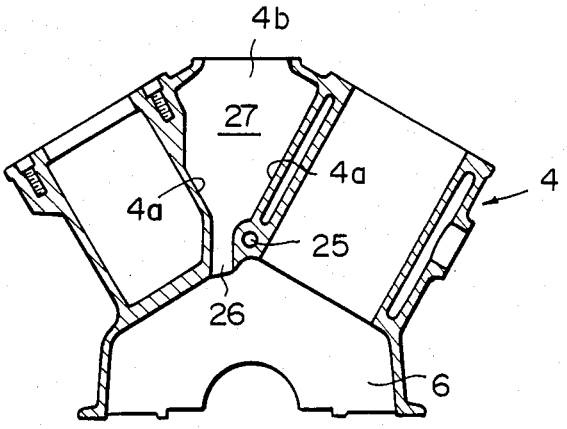
FIG. 6 is a cross-sectional view of the cylinder block.
Figure 7:
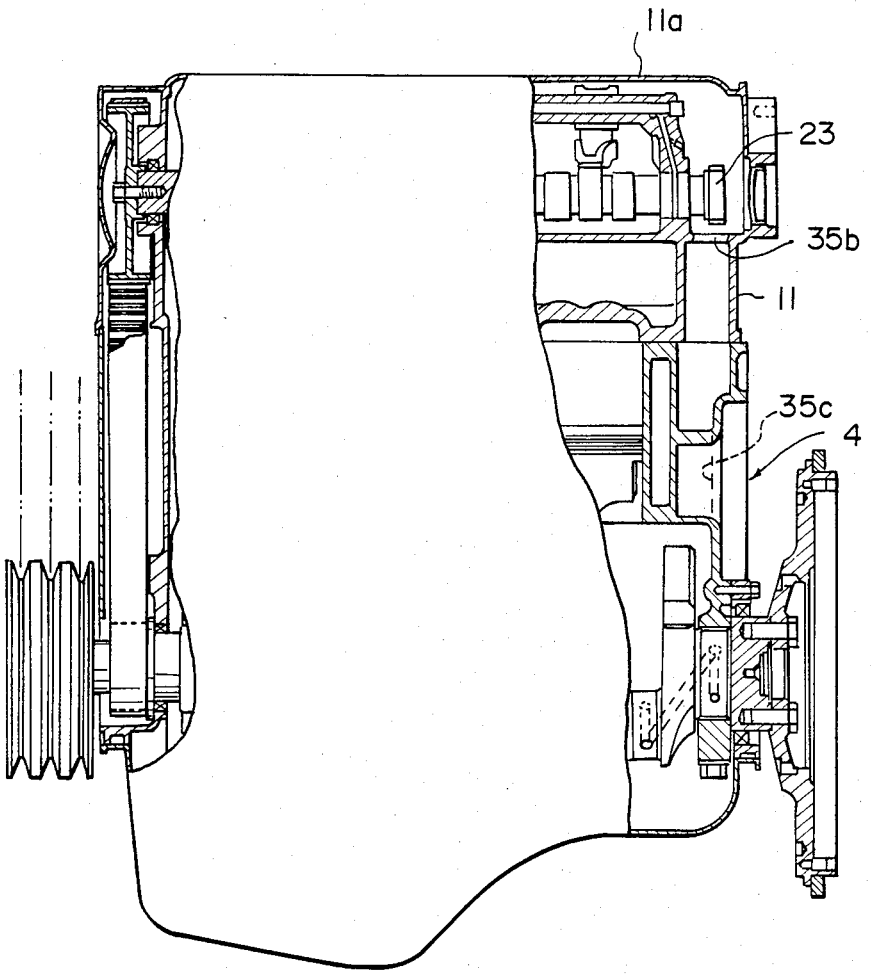
FIG. 7 is a side elevational view partly broken away of the second cylinder bank of the engine.
Figure 8:
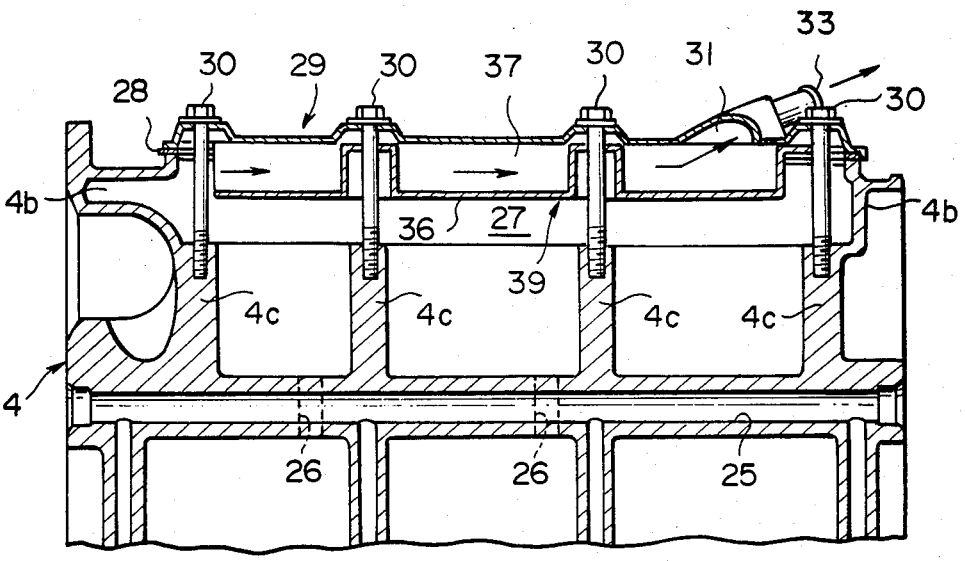
FIG. 8 is an enlarged cross-sectional view of the pressure buffer chamber defined in the engine.

As clearly shown in FIGS. 3 and 4, the front end face of the cylinder block 4 at the first cylinder bank 2 is substantially flush with that at the second cylinder bank 3, and the rear end face of the cylinder block 4 at the first cylinder bank 2 is substantially flush with that at the second cylinder bank 3. In each cylinder bank, there is formed a row of three cylinders 5. The row of the cylinders 5 in the first cylinder bank 2 starts from a location spaced apart from the front end face of the cylinder block 4 and terminates at a location near the rear end face of the same. The row of the cylinders 5 in the second cylinder bank 3 starts from a location near the front end face of the cylinder block 4 and terminates at a location spaced apart from the rear end face of the same. That is, the row of the cylinders 5 of the first cylinder 2 is axially rearwardly displaced from that of the second cylinder bank 3. The first cylinder bank 2 is provided with an oil-return passage 35*a* in the space between the front end face of the cylinder block 4 and the cylinder 5 nearest thereto in the first cylinder bank 2. The second cylinder bank 3 is provided with an oil-return passage 35*b* in the space between the rear end face of the cylinder block 4 and the cylinder 5 nearest thereto in the second cylinder bank 3. As will become apparent later, the oil-return passage 35*a* communicates with the space V defined between the head cover 11*a* and the cylinder head 11 of the first cylinder bank 2 and with the interior of the crankcase 8 to return oil from the valve driving mechanism M in the cylinder head 11 of the first cylinder bank 2 to the crankcase 8. Similary the oil-return passage 35*b* communicates with the space V defined between the head cover 11*a* and the cylinder head 11 of the second cylinder bank 3 and with the interior of the crankcase 8 to return oil from the valve driving mechanism M in the cylinder head 11 of the second cylinder bank 3 to the crankcase 8.

Figure 2:
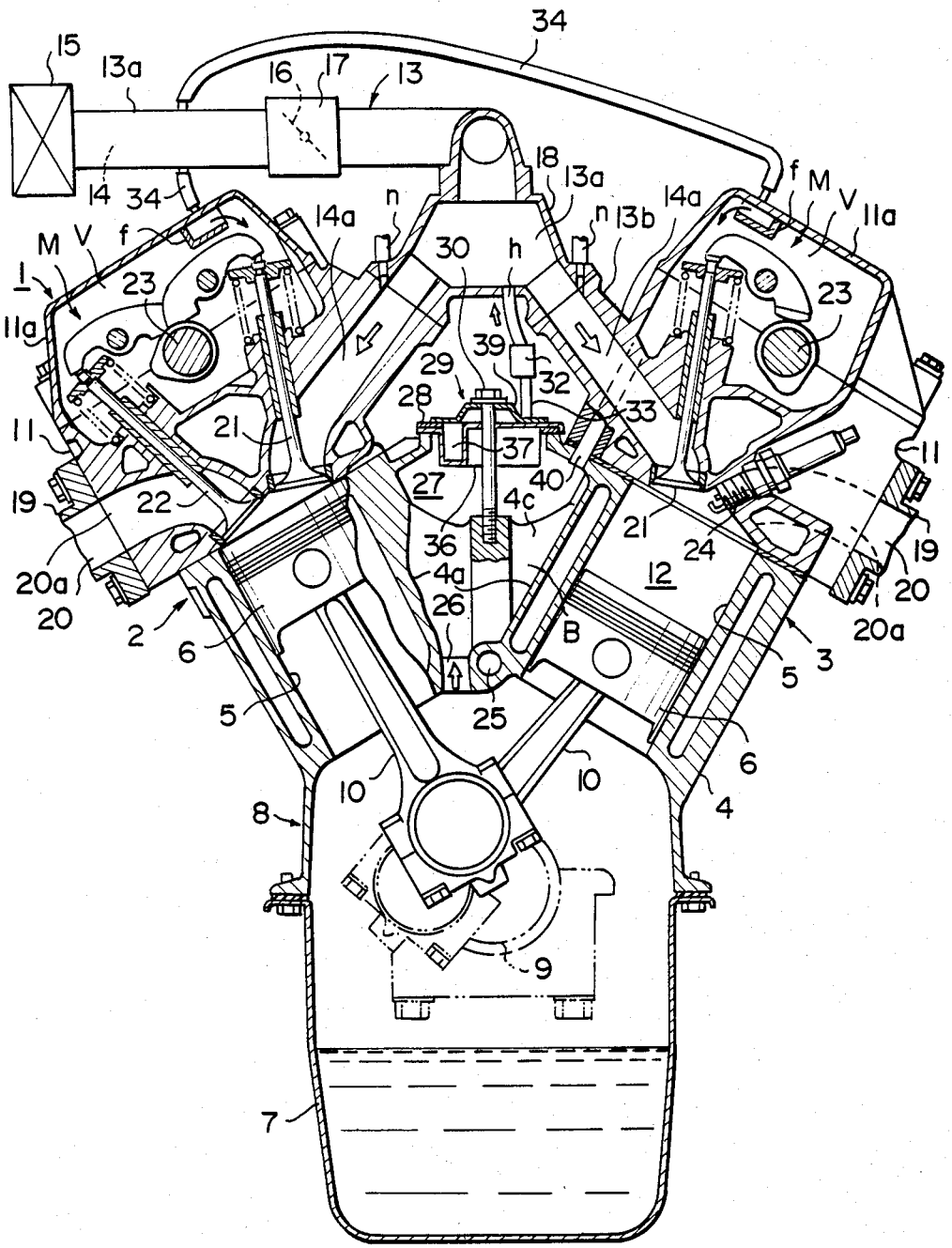
FIG. 2 is a cross-sectional view of the engine.

In FIG. 2, reference numerals 6 denote pistons which are connected to the crankshaft 9 by way of connecting rods 10, and reference numerals 12 denote combustion chambers in the respective cylinders 5. Further, reference numeral 13 denotes an intake pipe which forms an intake passage 14 for supplying the combustible charge into the combustion chambers 12. The intake pipe 13 includes an intake manifold portion 13*a* connected to an air cleaner 15 at its upstream end, and a plurality of pipe portions 13*b* branched from the downstream end of the manifold portion 13*a* through a surge tank 18. A throttle body 17 having a throttle valve 16 is disposed between the air cleaner 15 and the surge tank 18. The respective pipe portions 13*b* are communicated with the corresponding combustion chambers 12 through intake ports 14*a* at the downstream end of the intake passage 14. Fuel injection nozzles n are provided for the respective intake ports 14*a*. Exhaust pipes 19 are provided to constitute exhaust passages 20 for discharging exhaust gas from the combustion chambers 12. Intake valves 21 and exhaust valves 22 are provided for respectively closing and opening the intake ports 14*a* and the exhaust ports 20*a*. The intake valves 21 and the exhaust valves 22 are arranged to be driven by the valve driving mechanism M including said camshafts 23 which are mounted in the spaces V between the head covers 11*a* and the cylinder heads 11 and driven for rotation by the crankshaft 9 by way of the timing belt 54. Indicated at 24 and 25 are ignition plugs and a main oil gallery.

A space B having a substantially triangular cross section is defined between the opposed inner wall portions 4*a* of the first and second cylinder banks 2 and 3, and said main oil gallery 25 extends through the wall constituting the cylinder block 4 in an apex portion at the lower portion of the triangular cross section. In the space B, there is formed an enclosed pressure buffer chamber 27 communicated with the interior of the crankcase 8 through a plurality of communicating holes 26 (FIGS. 2 and 4) having a comparatively small diameter. The pressure buffer chamber 27 alleviates variation of pressure in the crankcase 8 due to increase of leakage of blow-by gas leaking from the combustion chambers 12 into the crankcase 8 in the explosion and expansion strokes, and due to pumping action of the pistons 6. The longitudinal side walls of the pressure buffer chamber 27 are formed by the opposed inner wall portions 4*a* of the first and second cylinder banks 2 and 3, and front and rear end walls of pressure buffer 27 are formed by wall portions 4*b* integrally formed with end portions of the cylinder block 4 to connect the banks 2 and 3 to each other. The upper portion of the pressure buffer chamber 27 is air-tightly closed by a lid member 29 provided with a sealing material 28. The lid member 29 is secured to ribs 4*c* (FIGS. 2 and 4) formed on the bottom of the pressure buffer chamber 27, by bolts 30 only one of which is shown in FIG. 2. At one edge portion of the above lid member 29, there is formed an opening 31 (FIG. 8), which is communicated with the intake passage 14 in the surge tank 18 through a communicating passage 33 provided with a pressure control valve 32, arranged to be opened when the intake negative pressure falls below a set value, and through a suitable hose h, whereby the blow-by gas in the crankcase 8 is first drawn into the pressure buffer chamber 27 by the intake negative pressure produced in the intake passage 14 downstream of the throttle valve 16, and thereafter, is fed into the intake passage 14 through the communicating passage 33 for combustion in the respective combustion chambers 12 together with intake air.

Said spaces V in the respective cylinder banks 2 and 3 are communicated with the intake passage 14 upstream of the throttle valve 16 by way of communicating passages 34. Said oil return passages 35*a* and 35*b* extend downwardly and are directly communicated with the interior of the crankcase 8 by way of communicating sections 35*c* and 35*d* (FIGS. 4, 5 and 7), respectively, so that oil in the spaces V of the first and second cylinder banks 2 and 3 can be quickly returned to the crankcase 8. Further, the oil return passages 35*a* and 35*b* are respectively commnicated with the front and rear ends of the pressure buffer chamber 27 at their intermediate portions and form a part of the buffer space of the pressure buffer chamber 27. The cross-sectional area of each communicating section is narrowed with respect to the cross-sectional area of the upper part of the oil-return passage to limit transmission of pressure variation in the crankcase 8, but it is larger than the communicating holes 26 so that oil can be quickly returned. Reference numerals 40 denote small diameter passages which directly communicate the spaces V with the pressure buffer chamber 27 so that a part of oil in the spaces V can be returned to the buffer chamber 27. In the case of a front engine rear drive vehicle, the rearwardly disposed oil-return passage 35*b* is generally more important than the forwardly disposed oil-return passage 35*a* since the front portion of the engine 1 is apt to be lifted with respect to the rear portion of the same in the vehicle and therefore oil is preferred to be returned to the crankcase 8 more quickly in the rear portion than in the front portion.

Since the spaces V in the respective cylinder banks 2 and 3 are communicated with the interior of the crankcase 8 by way of the oil-return passages 35*a* and 35*b*, the charge (air) in the intake passage 14 upstream of the throttle valve 16 is introduced into the crankcase 8 through the communicating passages 34 to ventilate the interior of the crankcase 8 when the pressure in the crankcase 8 is reduced due to the negative intake pressure through the communicating passage 33.

It should be noted that in the arrangement shown in FIG. 2, air is normally introduced into the spaces V through the communicating passages 34, but during heavy load operation as at a time when the throttle valve 16 is full opened, blow-by gas is increased so as to conversely flow into the intake passage 14 via the communicating passages 34. Therefore, there are provided oil separators f including baffle plates on the inner sides of the head covers 11*a* in positions confronting the open ends of the passages 34. Further a baffle plate 36 is provided in the pressure buffer chamber 27 to be opposed to the opening 31 for preventing splashes of oil within the buffer chamber 27 from being directly drawn into the communicating passage 33.

In the V-6 OHC engine 1 of this embodiment, oil discharged from the valve driving mechanisms M in the cylinder heads 11 can be quickly returned to the crankcase 8 by way of the oil-return passages 35*a* and 35*b* which are formed in the dead spaces in the first and second cylinder banks 2 and 3 and accordingly can be sufficiently large in cross-sectional area. Further, even when the pressure in the crankcase 8 is varied by increase, during the explosion and expansion strokes, in the amount of blow-by gas leaking out from the respective combustion chambers 12 into the crankcase 8, and by the pumping action of the pistons 6, the pressure variation can be minimized by the pressure buffer chamber 27 communicated with the interior of the crankcase 8 by way of the communicating holes 26. Further, the pressure variation in the in the spaces V in the cylinder heads 11 can be minimized by the pressure buffer chamber 27 communicated with the spaces V by way of the oil-return passages 35*a* and 35*b*.

It is needless to say that present invention need not be limited in its application to a V-6OHC engine but may readily applied to other multi-cylinder V-type engines.

As shown by the chained line in FIG. 3, an engine auxiliary mechanism 58 to be driven by the camshaft 23 such as a distributor may be mounted on the cylinder head 11 at a location corresponding to the oil-return passage 35*a* or 35*b* so that its driving shaft projects into the oil-return passage 35*a* or 35*b* with a worm gear 59 fixed to the lower part of the driving shaft being in mesh with a worm wheel 60 fixedly mounted on the camshaft 23.

We claim:

1. A V-type engine comprising a cylinder block, and first and second cylinder heads mounted on the cylinder block to form first and second cylinder banks arranged in V-shape, the front end face of the cylinder block at the first cylinder bank being substantially flush with the front end face of the same at the second cylinder bank, the rear end face of the cylinder block at the first cylinder bank being substantially flush with the rear end face of the same at the second cylinder bank, said first and second cylinder heads being shaped to conform to the shape of the cylinder block, each cylinder bank being provided with a row of cylinders extending axially between the front and rear end faces thereof, the row of the cylinders in the first cylinder bank starting from a location spaced apart from the front end face and terminating at a location near the rear end face and the row of the cylinders in the second cylinder bank starting from a location near the front end face and terminating at a location spaced apart from the rear end face so that the row of the cylinders in the first cylinder bank is axially rearwardly displaced from that in the second cylinder bank, characterized in that at least one oil-return passage communicating with a space defined by the corresponding cylinder head is formed in the cylinder block at, at least, one of the locations between the front end face of the cylinder block and the foremost cylinder in the first cylinder bank and between the rear end face of the cylinder block and the rearmost cylinder in the second cylinder bank.

2. A V-type engine as defined in claim 1 in which a pair of the oil-return passages are formed in the cylinder block respectively at locations between the front end face of the cylinder block and the foremost cylinder in the first cylinder bank and between the rear end face of the cylinder block and the rearmost cylinder in the second cylinder bank.

3. A V-type engine as defined in claim 2 in which a pressure buffer chamber communicating with the interior of the crankcase defined by the cylinder block is provided between the first and second cylinder banks.

4. A V-type engine as defined in claim 3 in which both said oil-return passages are communicated with the pressure buffer chamber, whereby said space defined by the cylinder heads are communicated with the interior of the crankcase.

5. A V-type engine as defined in claim 4 in which at least one of said oil-return passages is directly communicated with the interior of the crankcase by way of a communicating section.

6. A V-type engine as defined in claim 5 in which said communicating section is narrowed.

7. A V-type engine as defined in claim 2 in which said first and second cylinder heads are identical to each other and are positioned rotated by 180° with respect to each other.

* * * * *